US005841046A

United States Patent [19]

Rhodes et al.

[11] Patent Number: 5,841,046

[45] Date of Patent: Nov. 24, 1998

[54] HIGH STRENGTH, CORROSION RESISTANT AUSTENITIC STAINLESS STEEL AND CONSOLIDATED ARTICLE

[75] Inventors: Geoffrey O. Rhodes, Saxonburg; John J. Eckenrod, Moon Township; Frank J. Rizzo, McMurray; Michael W. Peretti, Washington; Ulrike Habel; William B. Eisen, both of Pittsburgh, all of Pa.

[73] Assignee: Crucible Materials Corporation, Syracuse, N.Y.

[21] Appl. No.: 652,686

[22] Filed: May 30, 1996

[51] Int. Cl.[6] ..... C22C 33/02

[52] U.S. Cl. ..... 75/246; 75/243; 75/244

[58] Field of Search ..... 75/246, 243, 244; 420/586.1, 584.1

[56] References Cited

U.S. PATENT DOCUMENTS

| | | | |
|---|---|---|---|
| 4,340,432 | 7/1982 | Hede | 148/11.5 |
| 4,545,826 | 10/1985 | McCunn et al. . | |
| 5,114,470 | 5/1992 | Biancaniello et al. | 75/338 |
| 5,141,705 | 8/1992 | Stenvall et al. | 420/584 |
| 5,298,093 | 3/1994 | Okamoto | 148/325 |
| 5,603,072 | 2/1997 | Kouno et al. | 419/25 |

FOREIGN PATENT DOCUMENTS

| | | |
|---|---|---|
| 0 300 362 A1 | 1/1989 | European Pat. Off. . |
| 0 438 992 A1 | 7/1991 | European Pat. Off. . |
| 0 438 992 B1 | 7/1991 | European Pat. Off. . |
| 0 626 460 A1 | 11/1994 | European Pat. Off. . |
| 60-218461 | 11/1985 | Japan . |
| 61-227153 | 10/1986 | Japan . |
| 03229815 | 10/1991 | Japan . |

OTHER PUBLICATIONS

Uggowitzer et al., "High Nitrogen Austenitic Stainless Steels—Properties and New Developments," Innovation Stainless Steel, Florence, Italy, Oct. 1993.

Zheng et al., "New High Nitrogen Wear and Corrosion Resistant Steels From Powder Metallurgical Process" Powder Metallurgy 1994, pp. 2125–2128.

Speidel et al., "High Nitrogen Stainless Steels in Chloride Solutions," Environmetal Effects, Sep. 1992, pp. 59–61.

Speidel, "Properties and Applications of High Nitrogen Steels,".

Simmons, "High–Nitrogen Alloying of Stainless Steels," Metallographic Characterization of Materials Behavior, 1994, pp. 33–49.

Satir–Kolorz et al., "On the Solubility of Nitrogen in Liquid Iron and Steel Alloys Using Elevated Pressure," Z. Metallkde, Bd. 82 (1991), H. 9 pp. 689–697.

Satir–Kolorz et al., "Literaturstudie und Theoretische Betrachtungen zum Lösungsverhalten von Stickstoff in Eisen–, Stahl– und Stahlgussschmelzen," Giessereforschung 42, 1990, No. 1, pp. 36–49 (with English Abstract).

Rhodes et al., "High Nitrogen Corrosion Resistant Austenitic Stainless Steels Made by Hot Isostatic Compaction of Gas Atomized Powder," Paper No. 416, Corrosion 96.

Rhodes et al., "High–Nitrogen Austenitic Stainless Steels with High Strength and Corrosion Resistance," JOM, Apr. 1996, pp. 28–30.

Rhodes et al., "HIP P/M Stainless and Ni–Base Components for Corrosion Resistant Applications," Modeling, Properties and Applications, Particulate Materials—1994, vol. 7, pp. 283–298.

Rechsteiner et al., "New Methods for the Production of High Nitrogen Stainless Steels," Innovation Stainless Steel, Florence, Italy, Oct. 1993, pp. 2.107–2.112.

Rechsteiner, "Metallkundliche und Metallurgische Grundlagen zur Entwicklung Stickstoffreicher, Zäher, Hochfester Austenitischer Stähle," Diss. ETH No. 10647, Zürich (with English abstract).

Reed, "Nitrogen in Austenitic Stainless Steels," JOM, Mar. 1989, pp. 16–21.

Rawers et al., "High Nitrogen Concentration in Fe–Cr–Ni Alloys," Metallurgical Transactions A, vol. 24A, Jan. 1993, pp. 73–82.

Pehlke et al., "Solubility of Nitrogen in Liquid Iron Alloys," Transactions of the Metallurgical Soc. of AIME, vol. 218, Dec. 1960, pp. 1088–1101.

Orita et al., "Development and Production of 18Mn–18Cr Non–Magnetic Retaining Ring with High Yield Strength," ISIJ International, vol. 30, 1990, No. 8, pp. 587–593.

Janowski et al., "Beneficial Effects of Nitrogen Atomization on an Austenitic Stainless Steel,"Metallurgical Transactions A, vol. 23A, Dec. 1992, pp. 3263–3272.

Foct, "High Nitrogen Steels: Principles and Properties," Innovation Stainless Steel, Florence Italy, Oct. 1993, pp. 2.391–2.396.

Feichtinger et al., "Powder Metallurgy of High Nitrogen Steels," PML, vol. 22, No. 6, 1990, pp. 7–13.

Feichtinger, "Alternative Methods for the Production of High Nitrogen Steels," Proceedings of International Conference on Stainless Steels, 1991, Chiba, ISIJ, pp. 1125–1132.

Eckenrod et al., "P/M High Performance Stainless Steels for Near Net Shapes," Processing, Properties, and Applications, Advances in Powder Metallurgy & Particulate Materials—1993, vol. 4, Metal Powder Industries Federation, Princeton, NJ, pp. 131–140.

"Nitrogen Alloying Boost for PM Stainless Steels," PM Technology Trends, MPR Jul./Aug. 1995, pp. 28–29.

(List continued on next page.)

*Primary Examiner*—Ngoclan Mai

*Attorney, Agent, or Firm*—Finnegan, Henderson, Farabow, Garrett & Dunner

[57] ABSTRACT

A consolidated, fully dense, high yield strength, austenitic stainless steel and article produced therefrom having improved pitting resistance and a low sigma solvus temperature. The article is produced from nitrogen gas atomized prealloyed particles. The steel and article have a high nitrogen content for increased strength and corrosion resistance.

14 Claims, 5 Drawing Sheets

OTHER PUBLICATIONS

Biancaniello et al., "Production and Properties of Nitrogenated Stainless Steel by Gas Atomization," Powder Metallurgy 1994, pp. 2117–2120.

Bandy et al., "Pitting–Resistant Alloys in Highly Concentrated Chloride Media," Corrosion–NACE, vol. 39, No. 6, Jun. 1983, pp. 227–236.

Berns, "High Nitrogen Stainless Steels," Stainless Steel Europe, Apr. 1994, pp. 56–59.

Berns, "Manufacture and Application of High Nitrogen Steels," Z. Metallkd. 86 (1995) 3, pp. 156–163.

ATP Quarterly Technical Progress Report, Jan. 31, 1996, "A Mathematical Model to Design Alloys with Superior Intragranular Stress Corrosion Cracking Resistance".

SET NITROGEN TO MEET YIELD STRENGTH CRITERION OF 620 MPa

⇩

DETERMINE Mo & Cr REQUIRED TO MEET A CORROSION REQUIREMENT OF PREN > 50

⇩

SET Mn AT 6 WT.% AND Ni AT 22 WT%

⇩

DETERMINE MO & CR FOR A FULLY AUSTENITIC ALLOY

⇩

DETERMINE Mo & Cr FOR T $\sigma$ < 1232° C

⇩

DETERMINE ALLOY COSTS OF MATERIALS RELATIVE TO Ni-16Cr-16Mo-3W ALLOY

⇩

DETERMINE Mo & Cr LEVELS WHICH WILL REQUIRE A NITROGEN GAS PRESSURE < 500 kPA

⇩

FROM Mo & Cr RANGES MEETING ALL CRITERIA, SELECT CANDIDATE ALLOYS

*FIG. 1*

HIGH STRENGTH, CORROSION RESISTANT AUSTENITIC STAINLESS STEEL AND CONSOLIDATED ARTICLE

BACKGROUND OF THE INVENTION

1. Field of the Invention

The invention relates to a consolidated, fully dense, high yield strength, austenitic stainless steel article produced from nitrogen gas atomized prealloyed particles.

2. Description of the Prior Art

In accordance with experimental work incident to development of the invention, a model has been formulated to design austenitic stainless steels containing 25 to 28% chromium, 22% nickel, 6% manganese, 4 to 8% molybdenum, and about 0.80% nitrogen. The newly developed steels of the invention have been produced by rapid solidification powder metallurgy (P/M) with subsequent consolidation by hot isostatic pressing (HIP). The resulting chemical compositions meet the criteria of the alloy design model, predicting a fully austenitic microstructure, a yield strength of about 620 MPa, a minimum Pitting Resistance Equivalence (PRE) number of 50, a sigma solvus temperature (Tσ) of less than 1232° C., a nitrogen equilibrium partial pressure at 1600° C. of about 500 kPa, and an alloy cost factor of 0.6 or less relative to UNS N10276. The results of experimental investigations of these steels compared to the predictions of the design model are presented hereinafter, in addition to evaluations of other HIP P/M processed austenitic and superaustenitic stainless steels, and nickel base corrosion resistant alloys.

Nitrogen is a strong austenite stabilizing alloying element that increases the strength and corrosion resistance of steels (Vol. III, Stainless Steels "Les Ulis Cedex A, France: European Powder Metallurgy Association," pp. 2117–2120). High nitrogen steels (HNS), and austenitic stainless HNS in particular, have recently received much attention in the technical literature. Information related to the strengthening effects of nitrogen in austenitic stainless steels, and interaction coefficients which may be useful in calculating the equilibrium nitrogen content of an austenitic stainless steel as related to nitrogen partial pressure have been presented. (M. O. Speidel, "Properties and Applications of High Nitrogen Steels," High Nitrogen Steels 88, Proceedings of the International Conference on High Nitrogen Steels, London: The Institute of Metals, 1989, pp. 92–96; Satir-Kolorz et al., Giessereiforschung, Vol. 42, No. 1, 1990, pp. 36–49; and Satir-Kolorz, et al., Z. Metallkde, Vol 82, No. 9, 1991, pp. 587–593.) Other literature discusses the effect of the alloying elements, including nitrogen, on the stability of the austenite phase in stainless steels. (Orita, et al., ISIJ International, Vol. 30, No. 8, 1990, pp. 587–593.) Corrosion resistance has been estimated using the PRE number, which is based upon the chromium, molybdenum, and nitrogen contents of an alloy. (Truman, "Effects of Composition on the Resistance to Pitting Corrosion of Stainless Steels," presented at U.K. Corrosion, 87, Brighton, England, Oct. 26–28, 1987.) Other corrosion literature indicates possible detrimental effects of the manganese content of austenitic stainless steels exceeding a threshold value, and the influence of the nickel content of austenitic stainless steels on stress corrosion cracking (SCC) resistance. (Bandy, et al., Corrosion, Vol. 39, No. 6, 1983, pp. 227–236; and Copson, "Effect of Nickel on the Resistance to Stress-Corrosion Cracking of Iron-Nickel-Chromium Alloys in Chloride Environments," 1st International Congress on Metallic Corrosion, London, Apr. 10–15, 1961, pp. 112–117.)

Powder metallurgy and hot isostatic pressing are well known practices and are described in detail in the prior art. (Eckenrod, et al., "P/M High Performance Stainless Steels for Near Net Shapes," Processing, Properties, and Applications Advances in Powder Metallurgy and Particulate Materials-1993, Vol. 4, (Princeton, N.J.: MPIF), pp. 131–140.) Briefly, controlled atmosphere or vacuum induction melting and gas atomization are used to produced rapidly solidified powder, which is subsequently consolidated to 100% density by HIP. The HIP P/M process results in a non-directional, fine grained microstructure and homogeneous chemical composition. The HIP P/M process was originally developed in the 1970's to produce high alloy tool steels and aerospace alloys with improved properties, and is now being used to produce corrosion resistant alloys. Many of the grades produced by HIP P/M are difficult to cast, forge, or machine as conventionally produced due to their high alloy content which may cause segregation during casting and hot working. The HIP P/M process eliminates segregation, allowing the fullest potential in corrosion resistance and mechanical properties to be attained based on chemical composition. HIP P/M not only may be used to make bar, slab, or tubular products similar in form to wrought materials, but near-net shapes as well. Earlier evaluations showed that HIP P/M materials meet the mechanical property and corrosion resistance requirements of conventional wrought counterparts. (Rhodes et al., "HIP P/M Stainless and Ni-Base Components for Corrosion Resistant Applications," Advanced Processing Techniques, Advances in Powder Metallurgy and Particulate Materials-1994, Vol. 7, (Princeton, N.J.: MPIF), pp. 283–298.) The nitrogen content of conventionally produced alloys is limited to the equilibrium nitrogen content which can be attained in the molten steel bath at atmospheric pressure. At atmospheric pressure, high nitrogen contents can be attained in austenitic stainless steels by increasing the alloying elements which increase the nitrogen solubility, such as manganese and chromium. Alternatively, in accordance with Sieverts Law, higher nitrogen contents can be obtained by increasing the nitrogen partial pressure over a bath of liquid steel. (Sieverts et al., Z. Phys, Chem., Abt. A 172, 1935, pp. 314–315.) Pressurized electroslag remelting (PESR) under a positive nitrogen pressure is one such production method. Other methods of increasing the nitrogen content of steels include solid state gas nitriding, or mechanical alloying of powders. (H. Byrnes, Z. Metallkd, Vol. 86, No. 3, 1995, pp. 156–163.) The inventors have determined that by gas atomization of UNS N08367 (Fe-24Ni-20Cr-6Mo), nitrogen contents substantially exceeding the predicted equilibrium value could be obtained. The melting and gas atomization, conducted in a nitrogen atmosphere at ambient pressure (100 kPa), resulted in nitrogen contents equivalent to a calculated nitrogen equilibrium pressure of about 350 kPa.

SUMMARY OF THE INVENTION

The invention comprises in one principal aspect thereof, a consolidated, fully dense, high yield strength, austenitic stainless steel and article thereof produced from nitrogen gas atomized prealloyed particles. The steel and article in one aspect of the invention, has a PRE greater than 55 and a Tσnot greater than 1232° C. The steel and article in other aspects of the invention has a maximum of 0.08% carbon, preferably equal to or less than 0.03%; 0.5 to 12.5% manganese, preferably 5.0 to 12.5%; 20 to 29% chromium, preferably 24 to 29%; 17 to 35% nickel, preferably 21 to 23%; 3 to 10% molybdenum, preferably 4 to 9%; not less than 0.7% nitrogen, preferably greater than 0.8% and more preferably 0.8 to 1.1%, and greater than 0.8 to 1.1%; up to 1.0% silicon, preferably 0.2 to 0.8%; up to 0.02% boron; up to 0.02% magnesium; up to 0.05% cerium; and the balance iron.

BRIEF DESCRIPTION OF THE DRAWINGS

FIG. 1 is a schematic diagram of the alloy design used in developing the HNS austenitic stainless steel to demonstrate the invention;

DETAILED DESCRIPTION AND EXAMPLES OF THE INVENTION

An alloy design model has been developed incorporating the above criteria. The HIP P/M high nitrogen stainless steels designed by this model are intended to be fully austenitic, have high strength and corrosion resistance, and have an alloy cost factor of 0.6 or less as compared to UNS N10276 (Ni-16Cr-16Mo-3W) which is often specified for demanding corrosion applications. The base composition of the alloy evaluated is Fe-6Mn-22Ni, with 25 to 28% chromium, 4 to 8% molybdenum, and about 0.8% nitrogen. The alloys are evaluated using standard mechanical property and corrosion resistance test methods in comparison to several HIP P/M UNS alloys.

EXPERIMENTAL PROCEDURE

Alloy Desiqn

A schematic diagram of the alloy design used in developing a HNS austenitic stainless steel to demonstrate the invention is shown in FIG. 1. By considering the combined effects of alloying elements on strength, corrosion resistance, microstructural stability, nitrogen solubility, and alloy cost, a matrix of candidate alloy compositions were determined.

Figure 2:
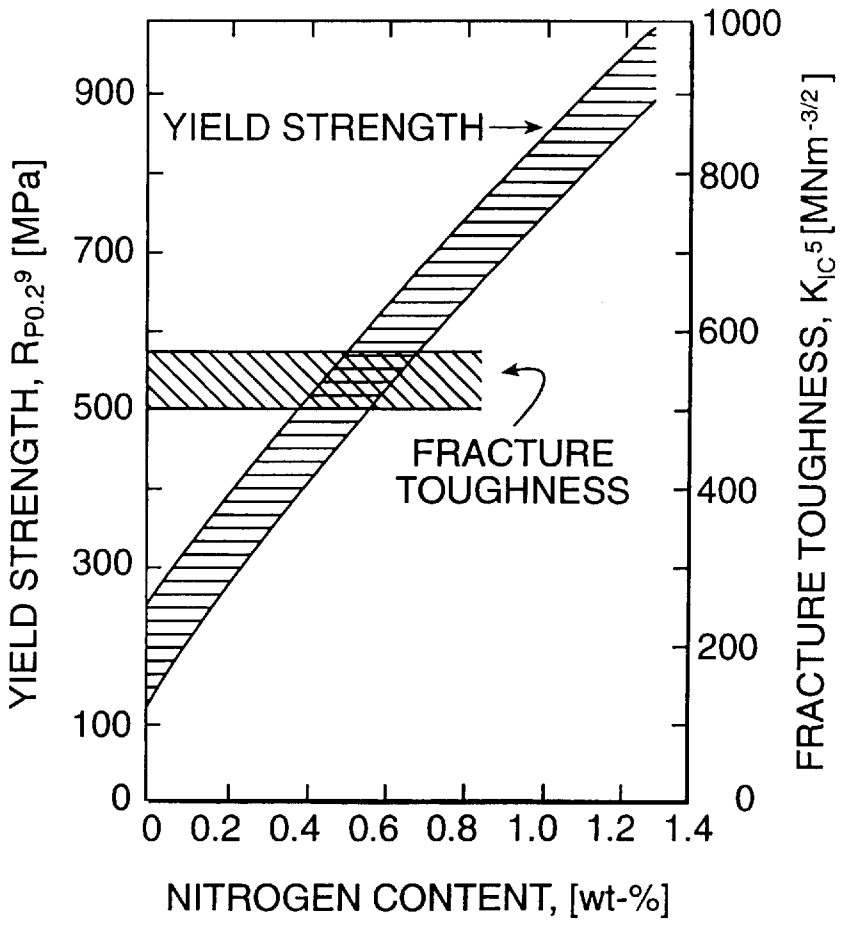
FIG. 2 is a graph showing the effect of nitrogen on the yield strength and fracture toughness of austenitic stainless steels.

Increased yield strength results from increased amounts LAW OFFICES of nitrogen in solid solution of Cr—Ni and Cr—Mn—Mo austenitic stainless steels, as illustrated in FIG. 2. (See, Speidel, High Nitrogen Steels, 88.) It was desired to provide a steel with a yield strength in the solution annealed condition of about 620 MPa, with a nitrogen content in solution of about 0.800.

The relative corrosion resistance of steels may be estimated based on the PRE number, calculated from the chromium, molybdenum, and nitrogen content (weight percent) as follows:

$$PRE=Cr+3.3Mo+16N \quad (1)$$

Although PRE factors for nitrogen as high as 30 have been reported, the more conservative value of 16 is used in the alloy design model to demonstrate the invention. PRE values of 35 to 45 typically indicate good resistance to localized attack of stainless steels in seawater, and a PRE value of 50 is desired for this alloy design. (Kovach et al., "Correlations Between the Critical Crevice Temperature, PRE Number and Long Term Crevice Corrosion Data for Stainless Steels," Corrosion/93, Paper No. 91, Houston, Tex.: NACE International, 1973.) By setting the PRE at 50, and nitrogen at 0.80%, a range of chromium and molybdenum contents satisfying equation 1 may be determined as shown by the lower boundary in FIG. 3.

As reported in the literature, manganese contents in excess of about 6% may have an undesirable effect on corrosion resistance and austenite stability, thus the manganese content of the alloy design model was set at 6%. (See, Bandy et al., Corrosion) Nickel is an austenite stabilizing element, but it also decreases nitrogen solubility. (See, Orita et al., ISIJ International.) To obtain an austenitic structure, stress corrosion cracking resistance, high nitrogen contents, and reduced alloy cost, the nickel content of the alloy design model was set at 22%. Nominal carbon contents of 0.02%, and silicon contents of 0.50% were selected.

Many investigations of austenite stability have been conducted, but for the purposes of this alloy design model, the relationship developed by Orita was utilized. (See, Orita et al., ISIJ International.) A chromium equivalent ($Cr_{eq}$) was determined as shown in equation 2.

$$Cr_{eq}=Cr+6Si+4Mo-[40C+2Mn+4Ni+30N] \quad (2)$$

If this $Cr_{eq}$ is less than −37, the alloys are fully austenitic. By substitution of the previously determined nitrogen, manganese, nickel, carbon, and silicon contents, a range of chromium and molybdenum contents may be determined as shown by the uppermost boundary in FIG. 3.

The formation of intermetallic phases was of concern in the alloy design model, as highly alloyed materials show a tendency to form intermetallic phases (such as sigma). Rechsteiner published an empirical relationship for the Tσ of alloys similar to UNS S32654, equation 3.

$$T\sigma(°C.)=26.4Cr+6.7Mn+50.9Mo+92.2Si-9.2Ni-17.9Cu-230.4C-238.4N+447 \quad (3)$$

(Rechsteiner, "Materials Science and Metallurgical Fundamentals for the Development of High-Nitrogen, Tough, High-Strength Austenitic Steels," Diss. ETH No. 10647, Doctoral Thesis, Zurich (Swiss Technical University), 1994.) The equation shows the strong effect which nitrogen has on depressing Tσ in these alloys. An annealing temperature in excess of 1232° C. is considered impractical for routine commercial production of steels. By solving equation 3 for 1232° C. and using the previously established alloying element values, a range of chromium and molybdenum contents may be determined. The Tσ boundary in FIG. 3 narrows the acceptable ranges of chromium and molybdenum for the design model alloy used to demonstrate the invention.

Thermodynamic considerations, specifically the nitrogen partial pressure ($PN_2$) at 1600° C. required to manufacture HNS of the alloy design, are based upon Sieverts law and interaction coefficients determined by Satir-Kolorz et al. (See, Sieverts et al., Z. Phys, Chem.; Satir-Kolorz et al., Giessereiforschung; and Satir-Kolorz et al., Z. Metallkde.) The inventors' experience, however, suggests that the nitrogen contents attainable by melting and gas atomization under a nitrogen pressure of about 100 kPa are equivalent to an equilibrium $PN_2$ of about 350 kPa, and an equivalent of about 500 kPa was believed possible. The thermodynamics for the alloy design model were solved for a range of chromium and molybdenum contents at a nitrogen content of 0.8% and a $PN_2$ of 500 kPa, as shown by the left boundary in FIG. 3.

Figure 3:
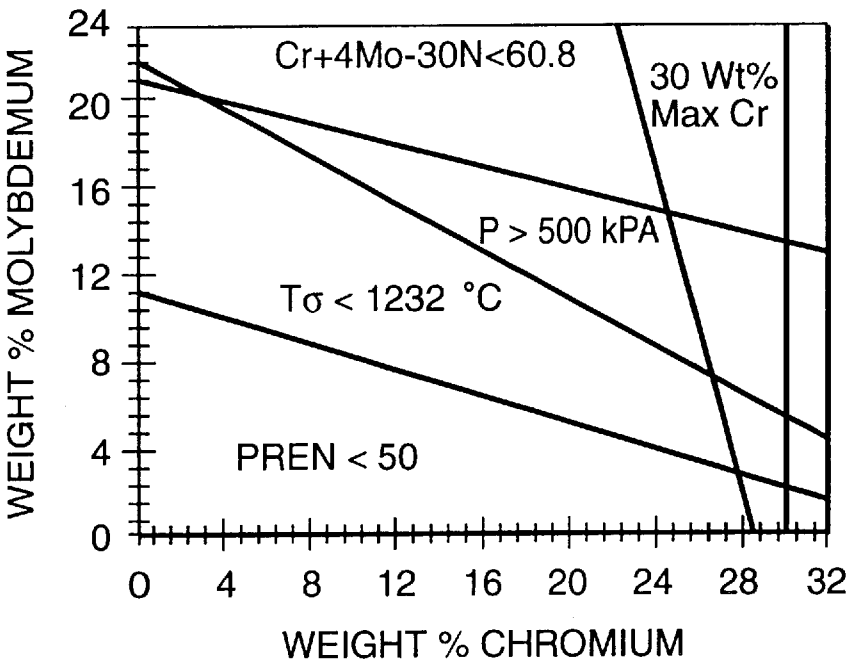
FIG. 3 is a graph showing the determination of chromium and molybdenum contents of experimental alloys.

Finally, due to cost considerations, the maximum chromium content considered for the alloy design model was set at 30%, the right boundary in FIG. 3. In addition, chromium is used in preference to molybdenum for cost considerations. The alloy design has therefore identified chromium contents of about 25 to 30% combined with molybdenum contents of about 4 to 8%.

Materials and Evaluations

Steels having chemical compositions meeting the alloy design criteria were induction melted and atomized using nitrogen gas. The powder yields of the 22 kg heats were screened to −60 mesh (−250 $\mu$m), then loaded into mild steel cans, which were outgassed and sealed. The powder filled cans were consolidated by HIP at 1130° C., 100 MPa, 4-hour hold, to 100% density.

The HIP consolidated materials were sectioned for density, metallographic, hardness, annealing, mechanical property, and corrosion resistance evaluations. Corrosion evaluations included 24-hour ferric chloride (6% $FeCl_3$) critical pitting temperature (CPT) and critical crevice temperature (CCT) evaluations per ASTM G-48. (ASTM G48–92, Standard Test Methods for Pitting and Crevice Corrosion Resistance of Stainless Steels and Related Alloys by the Use of Ferric Chloride Solution, Annual Book of ASTM Standards, Vol. 03.02 (Easton, Md.: ASTM, 1995), pp. 174–179.) CPT evaluations using testing procedures similar to ASTM G-48 were also conducted in Green Death solution (7 vol % $H_2SO_4$, 3 vol % HCl, 1 wt % $FeCl_3$,1 wt % $CuCl_2$). (Kirchheiner et al., "A New Highly Corrosion Resistant Material for the Chemical Process Industry, Flue Gas Desulfurization and Related Applications," Corrosion/90, Paper No. 90 (Houston, Tex., NACE International, 1990).) The test temperatures in the CPT and CCT evaluations were raised in 5° C. increments, and the test specimens were examined at 10 magnifications and probed for evidence of corrosion. For the CPT evaluations, the reported temperatures are the highest at which pitting was not observed on the specimen surfaces. For the CCT evaluations, the reported temperatures are the highest at which either no crevice corrosion was observed, or the corrosion rate was less than 0.05 millimeters per year (mmpy). Intergranular corrosion (IGC) resistance of the materials was evaluated using ASTM A262 Practice B, 120 hours boiling ferric sulfate-sulfuric acid (50% $H_2SO_4$, $Fe_2(SO_4)_3$). (ASTM A262-86, Standard Practices for Detecting Susceptibility to Intergranular Attack in Austenitic Stainless Steels, Annual Book of ASTM Standards, Vol. 01.03 (Easton, Md.: ASTM, 1991), pp. 42–59.) Corrosion rates of less than 1.2 mmpy are generally considered acceptable in this test. (Brown, Corrosion, Vol. 30, No. 1, 1974, pp. 1–12.) Tension specimens (25.4 mm gauge length) and full size Charpy V-notch impact specimens were tested at room temperature.

Solution annealing temperatures used for the test materials were determined by metallographic and scanning electron microscope (SEM) examinations of the annealed samples. Solution annealing temperatures were chosen from the lowest test temperature evaluated where metallographic and/or SEM examinations indicated that all intermetallic phases and chromium nitride precipitates were dissolved and a fully austenitic precipitate free matrix was obtained. The samples were annealed at the solution treating temperatures for one hour and water quenched.

Results

The chemical compositions of the materials produced in accordance with the alloy design model are shown in Table 1 along with the calculated PRE number, Tσ, equivalent $PN_2$, and alloy cost factor compared to UNS N10276. The chemical compositions of the alloys produced range from 24.56 to 28.24% chromium, 3.98 to 8.10 molybdenum, and 0.61 to 0.95% nitrogen. These chemical compositions result in calculated values of 49 to 65, Tσ values of about 990° to 1200° C., equilibrium $PN_2$ values of 300 to 1080 kPa, and alloy cost factors compared to UNS N10276 of 0.52 to 0.61. Although several of the nitrogen contents obtained are below the design criteria of 0.80%, most of the calculated $PN_2$ values are above the model design value of 500 kPa.

TABLE 1

CHEMICAL COMPOSITION, PRE, Tσ, $PN_2$, AND COST RATIO OF EXPERIMENTAL STEELS

| | Chemical Composition (wt %) | | | | | | | | | | Tσ | $PN_2$ | Cost |
|---|---|---|---|---|---|---|---|---|---|---|---|---|---|
| HEAT | C | Mn | P | S | Si | Ni | Cr | Mo | N | PRE | (°C.) | (kPa) | Ratio |
| L597 | 0.008 | 6.19 | 0.003 | 0.004 | 0.03 | 21.95 | 24.96 | 3.99 | 0.67 | 49 | 991 | 520 | 0.52 |
| L591 | 0.006 | 6.11 | 0.003 | 0.003 | 0.03 | 21.81 | 24.77 | 4.13 | 0.69 | 49 | 988 | 545 | 0.52 |
| L588 | 0.004 | 5.97 | 0.004 | 0.004 | 0.03 | 22.12 | 27.46 | 3.98 | 0.73 | 52 | 1039 | 475 | 0.54 |
| L587 | 0.005 | 6.09 | 0.010 | 0.004 | 0.04 | 22.30 | 28.24 | 4.27 | 0.64 | 53 | 1094 | 300 | 0.55 |
| L590 | 0.005 | 6.02 | 0.003 | 0.004 | 0.03 | 22.04 | 27.58 | 4.04 | 0.81 | 54 | 1026 | 625 | 0.54 |
| L592 | 0.010 | 6.06 | 0.003 | 0.004 | 0.03 | 22.07 | 24.73 | 6.06 | 0.70 | 56 | 1078 | 590 | 0.56 |
| L593 | 0.008 | 6.00 | 0.003 | 0.004 | 0.03 | 22.19 | 24.56 | 8.10 | 0.61 | 61 | 1199 | 375 | 0.61 |
| L589 | 0.003 | 5.91 | 0.003 | 0.003 | 0.40 | 21.88 | 27.84 | 5.98 | 0.93 | 63 | 1139 | 870 | 0.59 |
| L605 | 0.009 | 5.89 | 0.002 | 0.005 | 0.47 | 21.57 | 27.44 | 6.03 | 0.95 | 63 | 1135 | 965 | 0.59 |
| L606 | 0.008 | 5.96 | 0.002 | 0.003 | 0.50 | 21.42 | 24.77 | 7.94 | 0.89 | 65 | 1181 | 1080 | 0.61 |

Table 2 lists the nominal chemical compositions and calculated values of PRE, Tσ, $PN_2$, and alloy cost factor for several UNS materials evaluated in comparison to the experimental alloys. UNS S31603 is a 2% molybdenum austenitic stainless steel. UNS S31254, N08367, and S32654 contain 6% or more molybdenum, and are specialty austenitic or superaustenitic stainless steels currently used in demanding corrosive applications. UNS N10276 is a nickel base corrosion resistant alloy which is used in many severe corrosive applications. UNS S31603 and the 6% Mo alloys all have lower values of PRE, Tσ, and alloy cost ratio as compared to the experimental alloys, and are indicated to be producible at or below atmospheric pressure. UNS N10276 is a nickel base alloy and therefore, many of the chemical composition based calculated values are likely not applicable.

TABLE 2

NOMINAL CHEMICAL COMPOSITION, PRE, Tσ, $PN_2$, AND COST RATIO OF COMPARISON STEELS

| UNS | Nominal Chemical Composition (wt %) | | | | | | | | | Tσ | $PN_2$ | Cost |
|---|---|---|---|---|---|---|---|---|---|---|---|---|
| NO. | C | Mn | Si | Ni | Cr | Mo | N | Other | PRE | (°C.) | (kPa) | Ratio |
| S31603 | 0.02 | 1.00 | 0.30 | 11.0 | 18.0 | 2.0 | 0.1 | — | 26 | 927 | 25 | 0.3 |
| S31254 | 0.01 | 0.50 | 0.30 | 18.0 | 20.0 | 6.0 | 0.2 | — | 43 | 1093 | 85 | 0.5 |
| N08367 | 0.01 | 0.50 | 0.30 | 25.0 | 20.0 | 6.0 | 0.2 | — | 43 | 1032 | 110 | 0.5 |
| S32654 | 0.01 | 3.50 | 0.30 | 22.0 | 24.0 | 7.0 | 0.5 | 0.5 Cu | 55 | 1166 | 325 | 0.6 |
| N10276 | 0.005 | 0.50 | 0.30 | 60.0 | 16.0 | 16.0 | 0.02 | 4 W | 69 | 1143 | 10 | 1 |

Figure 4:
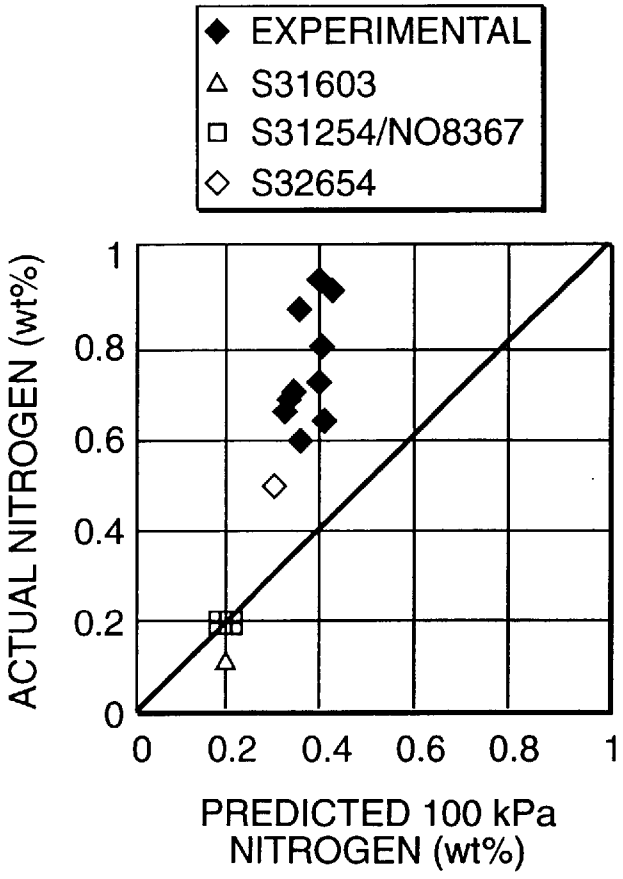
FIG. 4 is a graph showing the actual nitrogen contents versus predicted 100 kPa nitrogen partial pressure for experimental and comparison alloys.

FIG. 4 shows the nitrogen predicted at $PN_2$ of 100 kPa according to the thermodynamic model used in this study versus the actual reported (or nominal) nitrogen contents of the experimental and UNS alloys. The 2 and 6% molybdenum austenitic steels have nitrogen contents at or below the predicted equilibrium nitrogen content. The 7% molybdenum superaustenitic steel is slightly above the predicted equilibrium nitrogen content, and the experimental alloys are slightly or well above the predicted equilibrium nitrogen contents.

The experimental alloys were evaluated metallographically in the as-HIP and annealed conditions. As-HIP, the heats having about 25% chromium and 4 or 6% molybdenum exhibited heavy intergranular chromium nitride precipitation. The heats having about 25% chromium and 8% molybdenum, or 28% chromium and 6 or 8% molybdenum exhibited both intergranular and intragranular chromium nitride and intermetalic phase precipitates. X-ray diffraction and TEM examinations indicate that the chromium nitride precipitates are $Cr_2N$, and the intermetallic precipitates are sigma phase. By using the annealing temperatures in Table 3 and water quenching, the chromium nitride and sigma phase precipitates in all of the alloys were fully resolutioned.

Figure 5:
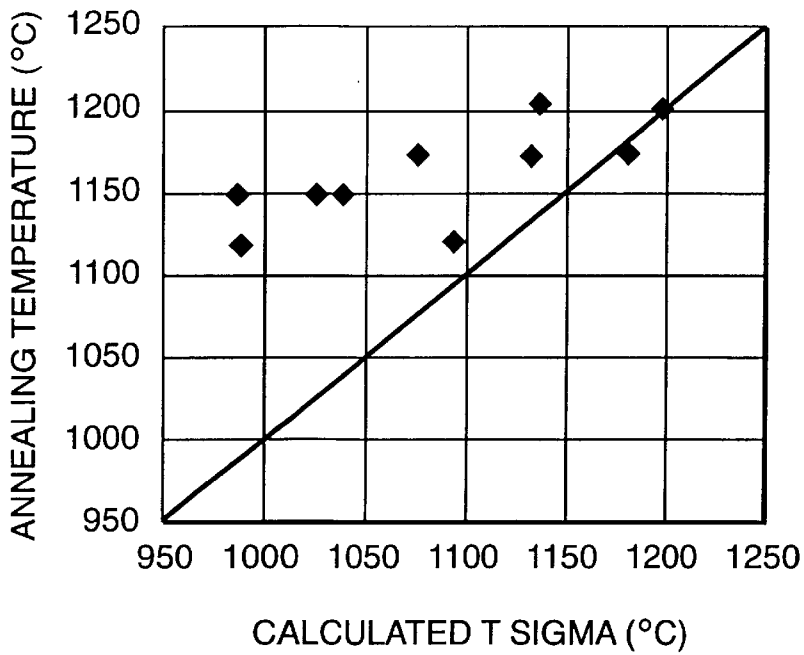
FIG. 5 is a graph showing the annealing temperature for experimental alloys versus calculated Tσ.

FIG. 5 shows the calculated Tσ values of the experimental alloys versus the actual solution annealing temperatures. In all but one of the alloys, the solution annealing temperatures used were higher than the calculated Tσ values. Annealing times of one hour were used in these evaluations but the Tσ empirical equation is based upon longer time studies, perhaps explaining why the annealing temperatures used are higher. (See, Rechsteiner, Doctoral Thesis.) Also, due to the slow cooling of the materials after HIP, the microstructures all contained chromium nitride precipitates which need to be resolutioned during the annealing treatments.

TABLE 3

CHEMICAL COMPOSITION VARIATION, ANNEALING TEMPERATURE, TENSILE PROPERTIES, AND IMPACT STRENGTH OF EXPERIMENTAL STEELS

| HEAT | Composition Variation (wt %) | | | Anneal Temp. | Tensile Strength | Yield Strength | Elongation in 2.5 cm | Red'n of Area | Energy Absorbed |
|---|---|---|---|---|---|---|---|---|---|
| NO. | Cr | Mo | N | (°C.) | (MPa) | (MPa) | (%) | (%) | (J) |
| L597 | 24.96 | 3.99 | 0.67 | 1121 | 1020 | 579 | 55 | 55 | 99 |
| L591 | 24.77 | 4.13 | 0.69 | 1148 | 1013 | 558 | 57 | 51 | 94 |
| L588 | 27.46 | 3.98 | 0.73 | 1148 | 1013 | 586 | 58 | 49 | 85 |
| L587 | 28.24 | 4.27 | 0.64 | 1121 | 1000 | 572 | 55 | 51 | 73 |
| L590 | 27.58 | 4.04 | 0.81 | 1148 | 1048 | 634 | 59 | 52 | 107 |
| L592 | 24.73 | 6.06 | 0.70 | 1176 | 1007 | 586 | 62 | 57 | 103 |
| L593 | 24.56 | 8.10 | 0.61 | 1204 | 979 | 551 | 54 | 43 | 87 |
| L589 | 27.84 | 5.98 | 0.93 | 1204 | 1041 | 682 | 68 | 60 | 144 |
| L605 | 27.44 | 6.03 | 0.95 | 1176 | 1048 | 702 | 68 | 62 | 134 |
| L606 | 24.77 | 7.94 | 0.89 | 1176 | 1027 | 676 | 69 | 64 | 133 |

Figure 6:
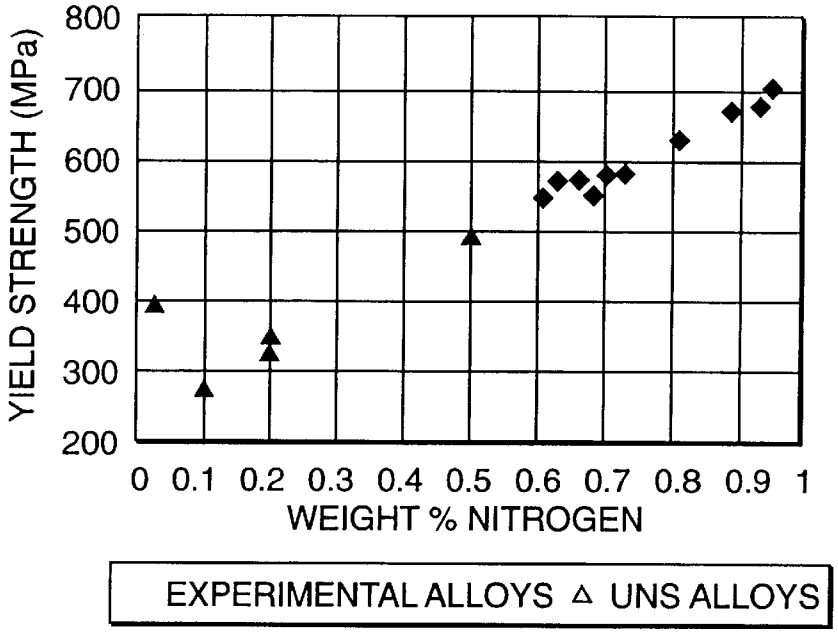
FIG. 6 is a graph showing yield strength versus nitrogen content of experimental and comparison alloys.

Results of tension and impact tests of the experimental alloys in the solution annealed condition and the solution annealing temperatures used are shown in Table 3. The materials all exhibit yield strengths of at least 550 MPa, and high tensile ductility. In addition, the energy absorbed values of the materials after annealing are reasonably high for this type of material, and suggest that no intermetallic precipitates are present. The results of tension tests of the HIP P/M comparison materials in the solution annealed condition are shown in Table 4. The reported values of these materials exceed the respective specified minimum properties for wrought materials. The yield strengths of the comparison materials are all lower than the experimental alloys, and FIG. 6 shows the yield strength values for the experimental and comparison alloys as a function of nitrogen content. Increased yield strength with increased nitrogen content is apparent for all of the austenitic stainless steels evaluated.

TABLE 4

NOMINAL CHEMICAL COMPOSITION AND TENSILE PROPERTIES OF COMPARISON STEELS

| UNS | Nominal Chemical Compositon (wt %) | | | Tensile Strength | Yield Strength | Elongation in 2.5 cm | Red'n of Area |
|---|---|---|---|---|---|---|---|
| NO. | Cr | Mo | N | (MPa) | (MPa) | (%) | (%) |
| S31603 | 18.0 | 2.0 | 0.1 | 586 | 290 | 55 | 15 |
| S31254 | 20.0 | 6.0 | 0.2 | 724 | 338 | 46 | 50 |

TABLE 4-continued

NOMINAL CHEMICAL COMPOSITION AND TENSILE PROPERTIES OF COMPARISON STEELS

| UNS | Nominal Chemical Compositon (wt %) | | | Tensile Strength | Yield Strength | Elongation in 2.5 cm | Red'n of Area |
|---|---|---|---|---|---|---|---|
| NO. | Cr | Mo | N | (MPa) | (MPa) | (%) | (%) |
| N08367 | 20.0 | 6.0 | 0.2 | 772 | 358 | 52 | 65 |
| S32654 | 24.0 | 7.0 | 0.5 | 930 | 496 | 48 | 42 |
| N10276 | 16.0 | 16.0 | 0.02 | 848 | 393 | 58 | 37 |

The results of corrosion test evaluations of the experimental alloys are listed in Table 5, and the comparison materials in Table 6. The low ASTM A262 Practice B test corrosion rates indicate that all of the experimental and comparison austenitic stainless steels are free of deleterious intergranular chromium carbide and likely also chromium nitride precipitation. The higher corrosion rate of the UNS N10276 alloy suggests that this material has less corrosion resistance in this test, and does not indicate that the material is insufficiently annealed.

TABLE 5

COMPOSITION VARIATION, PRE, AND CORROSION TEST RESULTS OF EXPERIMENTAL STEELS

| Heat | Composition Variation (wt %) | | | | Ferric Chloride Solution | | | Green Death | ASTM A262 |
|---|---|---|---|---|---|---|---|---|---|
| | | | | | CPT | CCT | CCT rate at | CPT rate at | Practice B |
| No. | Cr | Mo | N | PRE | (°C.) | (°C.) | 85° C. (mmpy) | 95° C. (mmpy) | (mmpy) |
| L597 | 24.96 | 3.99 | 0.67 | 49 | 95 | <85 | 2.40 | 0.33 | 0.23 |
| L591 | 24.77 | 4.13 | 0.69 | 49 | 95 | <85 | 1.00 | 0.17 | 0.19 |
| L588 | 27.46 | 3.98 | 0.73 | 52 | 95 | 85 | 0.01 | 0.02 | 0.17 |
| L587 | 28.24 | 4.27 | 0.64 | 53 | 95 | <85 | 0.51 | 0.05 | 0.27 |
| L590 | 27.58 | 4.04 | 0.81 | 54 | 95 | 95 | 0.04 | 0.01 | 0.16 |
| L592 | 24.73 | 6.06 | 0.70 | 56 | 95 | 95 | 0.02 | 0.01 | 0.18 |
| L593 | 24.56 | 8.10 | 0.61 | 61 | 95 | 95 | 0.00 | 0.00 | 0.32 |
| L589 | 27.84 | 5.98 | 0.93 | 63 | 95 | 95 | 0.01 | 0.00 | 0.11 |
| L605 | 27.44 | 6.03 | 0.95 | 63 | 95 | 95 | 0.00 | 0.00 | 0.52 |
| L606 | 24.77 | 7.94 | 0.89 | 65 | 95 | 95 | 0.01 | 0.00 | 0.53 |

TABLE 6

NOMINAL COMPOSITION, PRE, AND CORROSION TEST RESULTS OF COMPARISON STEELS

| UNS | Nominal Composition (wt %) | | | | Ferric Chloride | | Green Death | ASTM A262 |
|---|---|---|---|---|---|---|---|---|
| | | | | | CPT | CCT | CPT | Practice B |
| No. | Cr | Mo | N | PRE | (°C.) | (°C.) | (°C.) | (mmpy) |
| S31603 | 18 | 2 | 0.1 | 26 | 20 | 5 | 20 | 0.28 |
| S31254 | 20 | 6 | 0.2 | 43 | 60 | 45 | 55 | 0.30 |
| N08367 | 20 | 6 | 0.2 | 43 | 85 | 45 | 80 | 0.43 |
| S32654 | 24 | 7 | 0.5 | 55 | 95 | 70 | 95 | 0.33 |
| N10276 | 16 | 16 | 0.02 | 69 | 90 | 90 | 95 | 1.19 |

Figure 8:
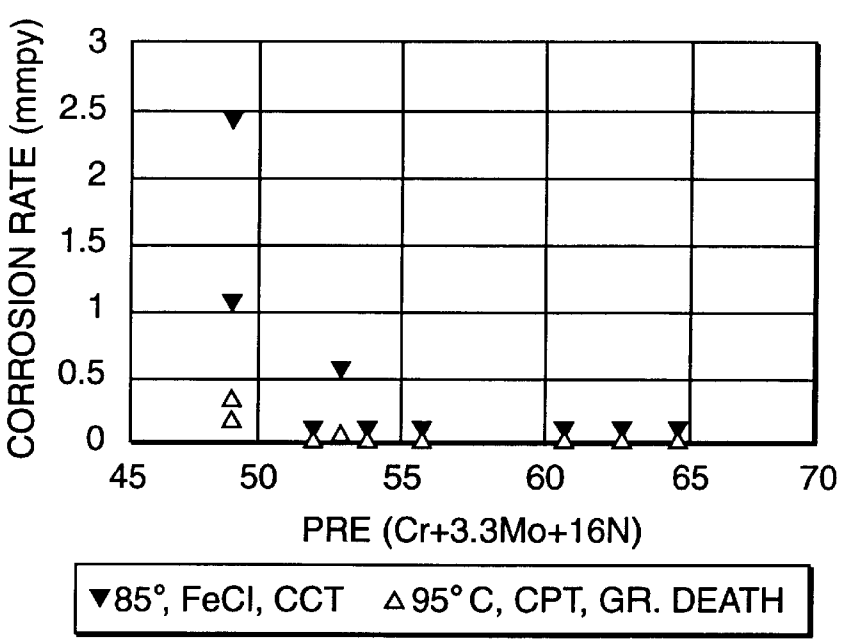
FIG. 8 is a graph of corrosion rate versus PRE of experimental alloys.
Figure 7:
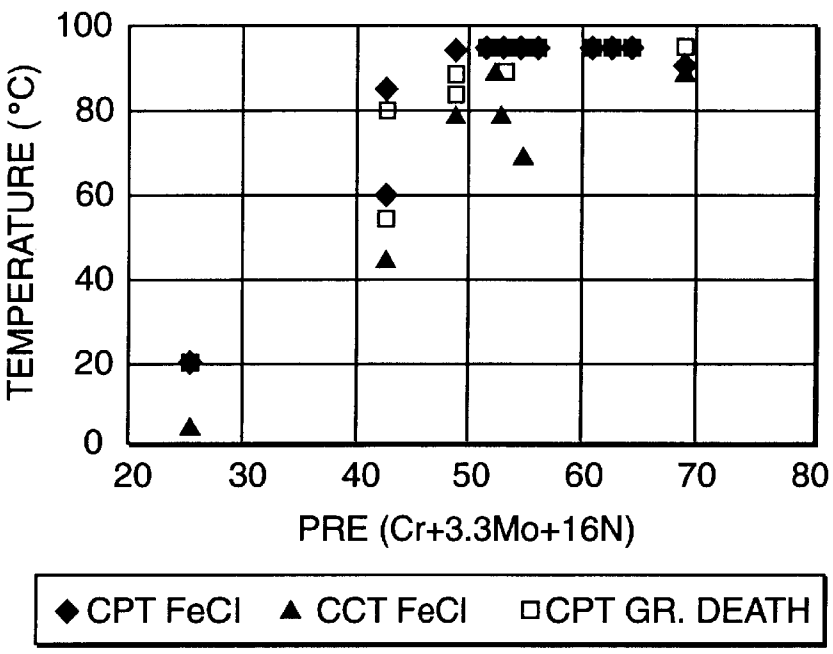
FIG. 7 is a graph of critical temperature versus PRE of experimental and comparison alloys.

All of the experimental alloys passed the $FeCl_3$ CPT test at 95° C., as did UNS S32654. The $FeCl_3$ CPT values of the other comparison materials are all lower. The values of the $FeCl_3$ CCT test for the experimental alloys are all higher than the austenitic stainless comparison materials, and range from less than 85° to 95° C. The 85° C. $FeCl_3$ CCT corrosion rates of the experimental alloys are listed, and generally decrease with increasing PRE value. The experimental alloys have Green Death CPTs of 90° or 95° C.; UNS S32654 and N10276 have similar CPTs, and the CPTs of the other comparison materials are lower. FIG. 7 shows the critical temperatures determined versus the PRE numbers of the experimental and comparison materials. It is indicated that a PRE number higher than about 55 is needed for best performance in the $FeCl_3$ and Green Death tests. FIG. 8 shows the 85° C. $FeCl_3$ CCT and 95° C. CPT corrosion rates of the experimental alloys versus PRE. Again, within the range of materials evaluated, a PRE of about 55 is needed to assure best performance in these tests.

Summary

A model to demonstrate the invention has been developed to permit the production of an austenitic stainless steel having high strength, excellent corrosion resistance, and an alloy cost factor of about 0.6 compared to UNS N10276. The base compositions of the alloys evaluated are Fe-6Mn-22Ni, with 25 to 28% chromium, 4 to 8% molybdenum, and 0.61 to 0.95% nitrogen.

The alloys were manufactured by HIP P/M, and the high nitrogen contents have an equilibrium $PN_2$ at 1600° C. of up to 1,100 kPa, despite the materials being produced at atmospheric (100 kPa) or slightly higher nitrogen pressure. UNS S32654 is also indicated to be produced at an elevated $PN_2$ at 1600° C., suggesting that the thermodynamic model may not be entirely accurate. However, steelmaking temperatures may be less than 1600° C. for these alloys, and nitrogen solubility increases with decreasing temperature in the liquid phase. (Zheng, et al., "New High Nitrogen Wear and Corrosion Resistant Steels from Powder Metallurgical Process," PM '94, Powder Metallurgy World Congress, Paris, Jun. 6–9, 1994, Vol. III.) Regardless of the accuracy of the model, it has been demonstrated that the P/M gas atomization process may be used to attain high nitrogen contents in as-atomized powder without modification to existing equipment.

After consolidation by HIP to 100% density, the experimental materials contained chromium nitride and sigma phase which precipitated during slow cooling from the HIP temperature. The experimental materials are fully austenitic after solution annealing at temperatures not higher than practically used in production. In the absence of sigma precipitation, annealing temperatures no lower than 1121° C. were required to re-solution the chromium nitride precipitates. Both of these precipitates are undesirable due to possible adverse effects on the corrosion resistance and mechanical properties.

The as-HIP microstructures of the experimental alloys demonstrate the beneficial effect of high nitrogen contents on reducing the tendency to form sigma phase, and the detrimental effect of higher chromium and molybdenum contents on sigma phase formation, as indicated by the Tσ equation. High molybdenum, chromium, and nitrogen contents, all of which are beneficial for improved corrosion resistance, may be used if the alloy is properly balanced to avoid sigma phase formation when fully solution annealed.

Tension testing of the experimental materials clearly demonstrates the strong strengthening effect of higher nitrogen contents in austenitic stainless steels. The strengthening effect of nitrogen determined in these evaluations was about a 520 MPa increase per one wt % nitrogen, and is in good agreement with published data. (See, Speidel, High Nitrogen Steels 88.) Even with the high tensile strengths attained, the materials did not have reduced ductility when properly solution annealed.

Improved corrosion resistance has also been demonstrated in the experimental materials, particularly by virtue of the high factor for nitrogen in the PRE equation. Evaluations of the experimental and comparison HIP P/M materials indicate that PRE numbers in excess of about 55 are needed for best performance in ferric chloride and Green Death CPT and CCT evaluations.

Beyond the alloy design model, the present evaluations suggest that other corrosion resistant alloys produced by HIP P/M could be improved by utilizing higher nitrogen contents. The anticipated benefits for such modification to other corrosion resistant alloys are improved corrosion resistance, higher strength, and less tendency for sigma phase formation.

As is well known, the addition of copper up to about 3.5% to austenitic stainless steels improves corrosion resistance to reducing acids and thus copper may be added to the compositions in accordance with this invention. Boron, magnesium, and cerium are known to improve the hot workability of compositions in accordance with the invention.

Conclusions

An alloy design model has been used to develop austenitic stainless steels having a base chemical composition of Fe-6Mn-22Ni-25/28Cr-4/8Mo-0.6/0.9N. Evaluations of these materials, produced by HIP P/M, meet the model design criteria of having a fully austenitic microstructure, high yield strength, a minimum PRE of 50, a Tσ of less than 1232° C., a $P_{N2}$ at 1600° C. of 500 kPa or more, and a cost factor of about 0.6 compared to UNS N10276. The following conclusions are based on evaluations of the experimental alloys produced by the design model, and comparison with other HIP P/M corrosion resistant alloys.

1. Gas atomization P/M can be used to produce nitrogen contents substantially higher than the equilibrium content predicted by existing thermodynamic models.
2. The yield strength of austenitic stainless steels increases with increasing nitrogen content, and high ductility and impact strength can be maintained with proper annealing.
3. HIP P/M highly alloyed austenitic stainless steels may contain undesirable precipitates after slow cooling from the HIP temperature, but a fully austenitic microstructure can be attained by using proper solution annealing temperatures. Nitrogen is a particularly useful alloying element in this regard, as it is a low cost austenite forming element which reduces the tendency for sigma phase formation.
4. The corrosion resistance of austenitic stainless steels, evaluated in ferric chloride and Green Death solutions, increases with increasing PRE number. High nitrogen steels, by virtue of the high PRE factor for nitrogen, exhibit excellent performance in these tests.
5. PRE numbers of 55 or greater are required for best performance in ferric chloride and Green Death test solutions.
6. High nitrogen austenitic stainless steels exhibit higher strength, with equivalent or better corrosion resistance than UNS N10276 in many environments, but with an alloy cost factor of about 0.6.

What is claimed is:

1. A consolidated, fully dense, high yield strength, austenitic stainless steel article produced from nitrogen gas atomized prealloyed particles, said article having a PRE greater than 55 and a Tσ not greater than 1232° C.

2. The article of claim 1, having not less than 0.7 weight percent N.

3. The article of claim 1, having greater than 0.7 weight percent N.

4. The article of claim 1, having 0.8 to 1.1 weight percent N.

5. The article of claim 1, having greater than 0.8 to 1.1 weight percent N.

6. A high yield strength, austenitic stainless steel, consisting essentially of, in weight percent, a maximum of 0.08 C, 0.5 to 12.5 Mn, 20 to 29 Cr, 17 to 35 Ni, 3 to 10 Mo, greater than 0.7 N, up to 1.0 Si, up to 0.02 B, up to 0.02 Mg, up to 0.05 Ce, and balance Fe.

7. The steel of claim 1, consisting essentially of, in weight percent, not more than 0.03 C, 5.0 to 12.5 Mn, 24 to 29 Cr., 21 to 23 Ni, 4 to 9 Mo, 0.8 to 1.1N, 0.2 to 0.8 Si, and balance Fe.

8. The steel of claim 7, having greater than 0.8 to 1.1N.

9. A high yield strength, austenitic stainless steel having a PRE greater than 55, Tσ not greater than 1232° C., and consisting essentially of, in weight percent, a maximum of 0.08 C, 0.5 to 12.5 Mn, 20 to 29 Cr, 17 to 35 Ni, 3 to 10 Mo, greater than 0.7N, up to 1.0 Si, up to 0.02 B, up to 0.02 Mg, up to 0.05 Ce, and balance Fe.

10. The steel of claim 9, consisting essentially of, in weight percent, not more than 0.03 C, 5.0 to 12.5 Mn, 24 to 29 Cr, 21 to 23 Ni, 4 to 9 Mo, 0.8 to 1.1N, 0.2 to 0.8 Si, and balance Fe.

11. The steel of claim 10, having greater than 0.8 to 1.1N.

12. A consolidated, fully dense, high yield strength, austenitic stainless steel article produced from nitrogen gas atomized prealloyed particles, said article having a PRE greater than 55, Tσ not greater than 1232° C., and consisting essentially of, in weight percent, a maximum of 0.08 C, 0.5 to 12.5 Mn, 20 to 29 Cr, 17 to 35 Ni, 3 to 10 Mo, not less than 0.7N, up to 1.0 Si, up to 0.02 B, up to 0.02 Mg, up to 0.05 Ce, and balance Fe.

13. The article of claim 12, consisting essentially of, in weight percent, not more than 0.03 C, 5.0 to 12.5 Mn, 24 to 29 Cr, 21 to 23 Ni, 4 to 9 Mo, 0.8 to 1.1N, 0.2 to 0.8 Si, and balance Fe.

14. The article of claim 13, having greater than 0.8 to 1.1N.

* * * * *

UNITED STATES PATENT AND TRADEMARK OFFICE

CERTIFICATE OF CORRECTION

PATENT NO. : 5,841,046

DATED : November 24, 1998

INVENTOR(S) : Geoffrey O. RHODES et al.

It is certified that error appears in the above-identified patent and that said Letters Patent is hereby corrected as shown below:

In claim 12, column 12, line 54, "not less" should read --greater--.

Signed and Sealed this

Fifteenth Day of June, 1999

*Attest:*

Q. TODD DICKINSON

*Attesting Officer*

*Acting Commissioner of Patents and Trademarks*